US008820304B2

(12) United States Patent
Batdorf

(10) Patent No.: US 8,820,304 B2
(45) Date of Patent: Sep. 2, 2014

(54) ADJUSTABLE ROLLER GUARD FOR ARCHERY BOW

(75) Inventor: Richard Batdorf, Mt. Arlington, NJ (US)

(73) Assignee: Archery America, L.L.C., DeQuincy, LA (US)

( * ) Notice: Subject to any disclaimer, the term of this patent is extended or adjusted under 35 U.S.C. 154(b) by 436 days.

(21) Appl. No.: 13/226,827

(22) Filed: Sep. 7, 2011

(65) Prior Publication Data

US 2013/0055995 A1 Mar. 7, 2013

(51) Int. Cl.
*F41B 5/14* (2006.01)
*F41B 5/10* (2006.01)

(52) U.S. Cl.
CPC .... *F41B 5/10* (2013.01); *F41B 5/14* (2013.01)
USPC ..... 124/25.6

(58) Field of Classification Search
CPC ..... F41B 5/10; F41B 5/14; F41B 5/1426; F41B 5/148; F41B 5/1411; F41B 5/1407; F41B 5/1415
USPC ..... 124/25.6, 90, 900
See application file for complete search history.

(56) References Cited

U.S. PATENT DOCUMENTS

| | | | | |
|---|---|---|---|---|
| 4,207,858 | A * | 6/1980 | Blackstone | 124/25.6 |
| 5,983,880 | A | 11/1999 | Saunders | |
| 6,152,124 | A | 11/2000 | Gallops | |
| 6,550,467 | B2 | 4/2003 | Gallops | |
| 6,634,348 | B2 | 10/2003 | Gallops | |
| 6,708,684 | B2 | 3/2004 | Chattin | |
| 6,722,354 | B1 | 4/2004 | Land | |
| 6,904,900 | B2 | 6/2005 | Gallops | |
| 7,793,646 | B2 | 9/2010 | Cooper | |
| 2003/0056780 | A1 * | 3/2003 | Gallops, Jr. | 124/92 |
| 2011/0073090 | A1 | 3/2011 | McPherson | |

* cited by examiner

*Primary Examiner* — Gene Kim
*Assistant Examiner* — Amir Klayman
(74) *Attorney, Agent, or Firm* — Schultz & Associates, P.C.

(57) ABSTRACT

An adjustable cable guard for archery bows includes a guard holder and a cable guard held by the guard holder to engage a cable of the bow to maintain the cable a predetermined distance from a drawstring of the bow. The guard holder includes a body having a clamping groove having a length axis and a bifurcating slit that extends from the clamping groove into the body of the holder, and the cable includes a tongue located to be matingly and slidingly received by the clamping groove. The position of the tongue within the clamping groove may be locked against movement by compressing the slit to bear surfaces of the clamping groove against surfaces of the tongue.

9 Claims, 4 Drawing Sheets

ADJUSTABLE ROLLER GUARD FOR ARCHERY BOW

FIELD

This disclosure relates to the field of cable guards for archery bows. More particularly, this disclosure relates to a roller cable guard that enables quick and easy adjustability of the position of the cable guard so that the cable guard may be readily adjusted to desirably clear the fletching on the arrow.

BACKGROUND

Compound bows often include a cable guard to hold the cables out of the path of the arrow. One popular type of cable guard is a roller cable guard that uses one or more rollers or pulleys to receive the cables of the bow. Conventional cable guards of this type are installed and often positioned to maintain the cables of the bow to just clear the fletching on an arrow of the largest standard size. The fletching on the arrow is provided to stabilize the flight of the arrow and is generally present as fins, vanes, or the like on the distal end (remote from the point) of the arrow.

Conventional roller cable guards work suitably with arrows of a single type having substantially uniformly dimensioned fletching. However, in the event the archer desires to shoot arrows having different fletching dimensions, the position of the cable guard as set for the previous fletching can be disadvantageous. For example, insufficient arrow clearance will cause contact between the cables and the fletching and detrimentally affect the flight of the arrow. Alternatively, excessive arrow clearance may cause the cables to track incorrectly on the wheels and/or creates unnecessary side torque on the wheels which can adversely affect bow action. Any of these can potentially result in serious personal injury and/or damage to the bow, and are otherwise disadvantageous. Conventional cable guards may be re-installed to be suitable with differently sized arrows, but such is cumbersome and time consuming.

Accordingly, what is desired is an archery cable guard that enables quick and easy adjustability of the position of the cable guard so that the cable guard may be readily adjusted to desirably clear the fletching on the arrow.

SUMMARY

The above and other needs are met by an adjustable cable guard for archery bows. In one embodiment, the guard includes a guard holder and a cable guard held by the guard holder to engage a cable of the bow to maintain the cable a predetermined distance from a drawstring of the bow.

The guard holder includes a body having an open ended clamping groove having a length axis and a bifurcating slit that extends from the clamping groove into the body of the holder. The width of the clamping groove may be changed by application and removal of a compressive force to the slit.

The cable guard includes a surface to bear against the cable of the bow and a tongue located to be matingly and slidingly received by the clamping groove of the guard holder. The tongue may move along the length of the groove to enable adjustment of the position of the cable guard relative to the clamping groove to position the cable at a predetermined spacing from the drawstring of the bow. The position of the tongue within the groove may be locked against movement by compressing the slit to bear surfaces of the clamping groove against surfaces of the tongue to clamp the tongue against movement and thereby maintain the cable at the predetermined spacing from the drawstring of the bow.

BRIEF DESCRIPTION OF THE DRAWINGS

Further advantages of the disclosure are apparent by reference to the detailed description when considered in conjunction with the figures, which are not to scale so as to more clearly show the details, wherein like reference numbers indicate like elements throughout the several views, and wherein.

DETAILED DESCRIPTION

Figure 1:
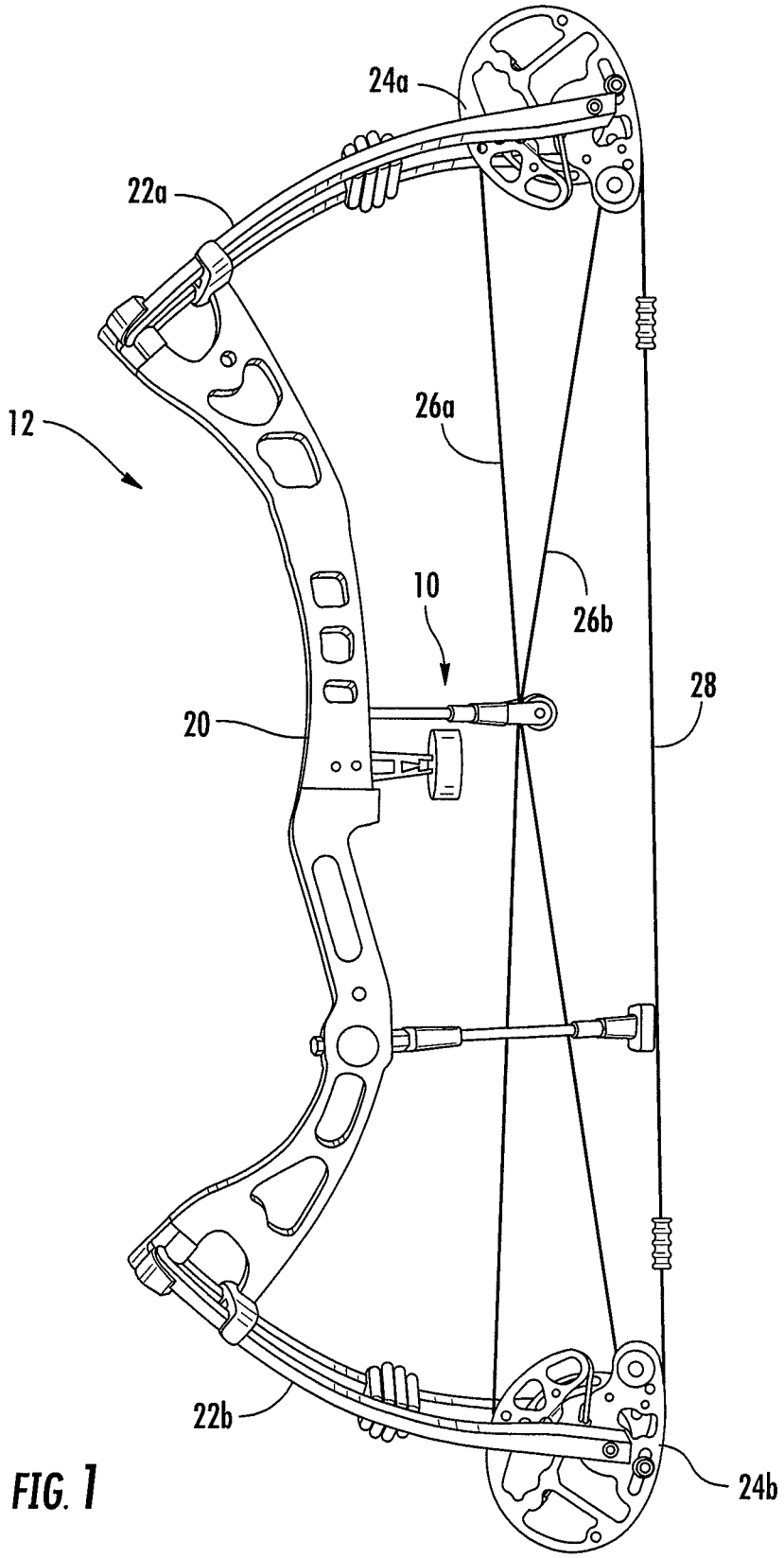
FIG. 1 is a perspective view of an archery bow having an adjustable roller guard system according to a preferred embodiment of the disclosure.
Figure 2:
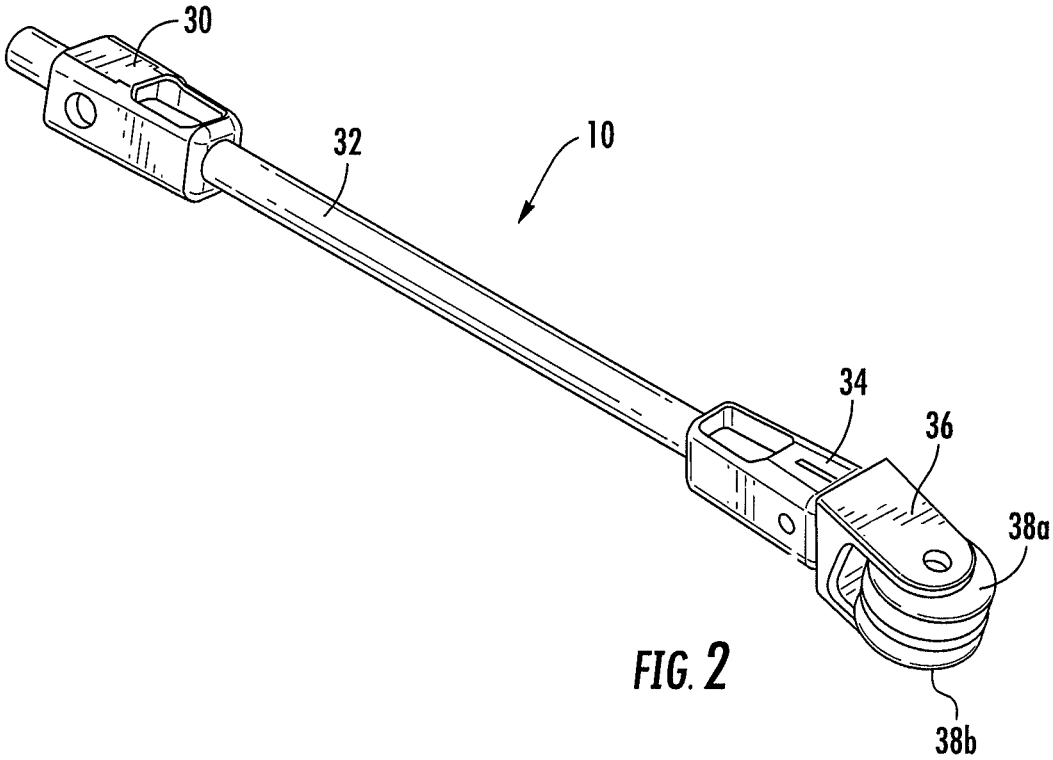
FIGS. 2 and 3 are perspective views of the adjustable roller guard system of FIG. 1.

With reference to FIG. 1, there is shown an adjustable roller guard system 10 for use with a compound archery bow 12 according to a preferred embodiment of the disclosure.

The bow 12 includes a handle or riser 20, limbs 22*a* and 22*b*, cams or wheels 24*a* and 24*b*, cable portions 26*a* and 26*b*, and drawstring 28.

The adjustable roller guard system 10 includes a riser mount 30, a rod 32, a guard holder 34, and a cable guard 36 having rollers 38*a* and 38*b*. For low weight and stiffness, the riser mount 30, rod 32, holder 34, and guard 36 may be made of carbon fiber or the like.

Figure 5:
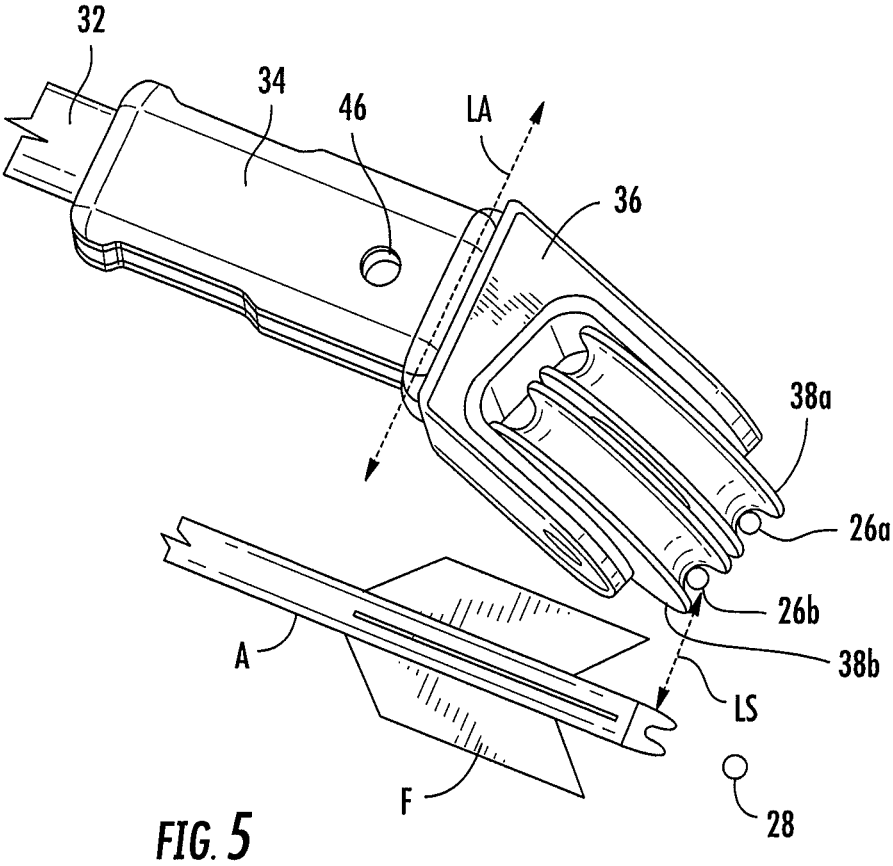

The system 10 is configured so that the lateral position of the cable guard 36 may be laterally adjusted along a lateral axis LA of the roller guard system 10 that is substantially perpendicular to the length axis of the rod 32 (FIG. 3) to maintain the cable portions 26*a* and 28*a* of the bow 12 at a desired lateral spacing LS from the drawstring 28 (FIG. 5). In this regard, the desired lateral spacing LS is typically a spacing selected so that the cable portions 26*a* and 26*b* just clear the fletching on an arrow being shot by the bow 12 using the drawstring 28. For example, a clearance of from about 1/16 to about 5/16 of an inch is generally desired.

The rod 32 may be mounted directly to the riser 20 as by apertures or the like located on the riser 20, but it is preferred to utilize the mount 30. The mount 30 serves to stiffen the connection between the rod 32 and the riser 20 and enables quick attachment and detachment of the guard system 10 to the bow 12. The guard holder 34 is frictionally retained on the distal end of the rod 32 and the cable guard 36 is frictionally retained on the guard holder 36. The rollers 38*a* and 38*b* are rotationally mounted on the cable guard 36.

Figure 3:
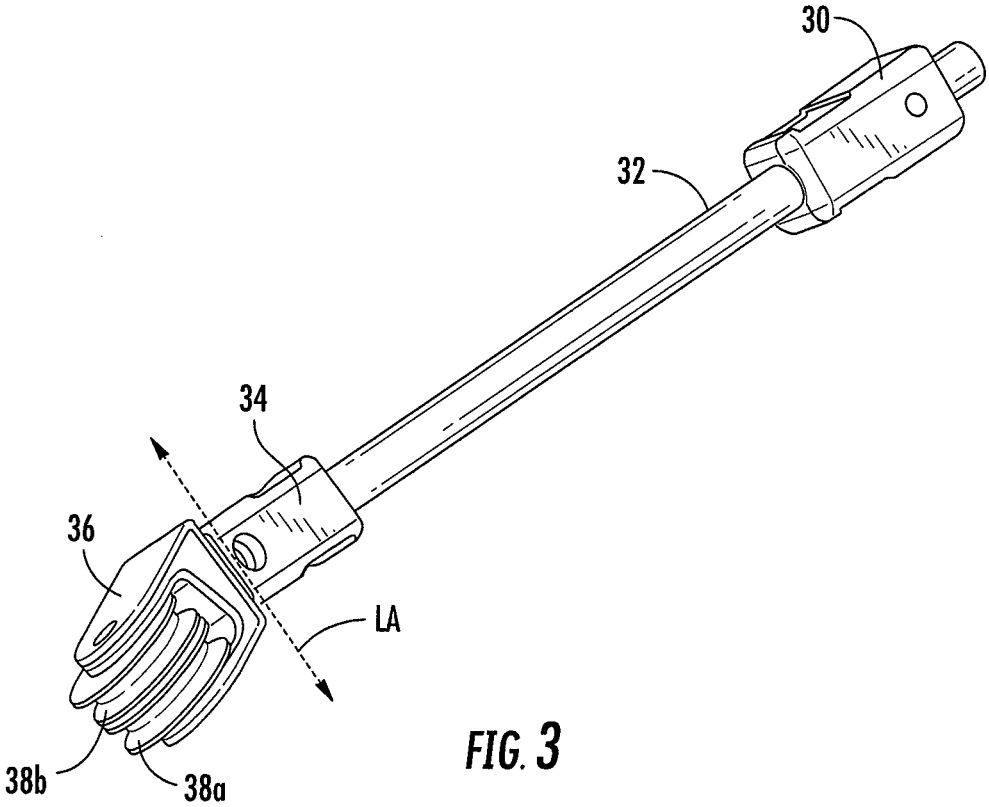
Figure 4:
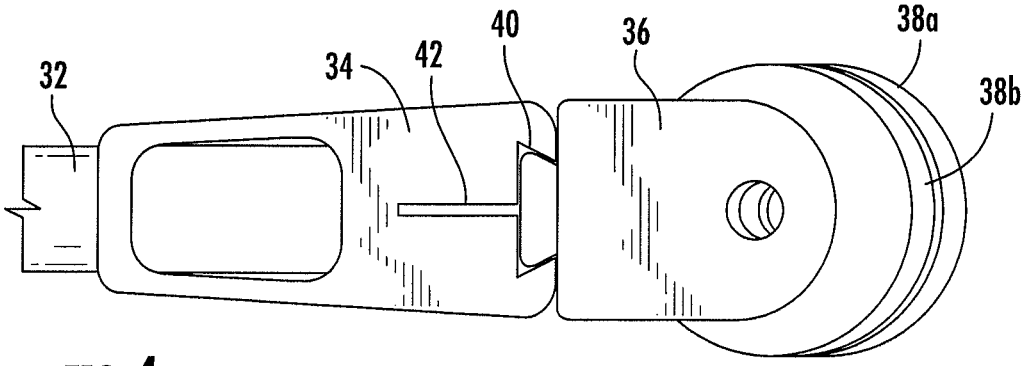
FIGS. 4 and 5 are close-up views of a portion of the adjustable roller guard system of FIG. 1.

The guard holder 34 and the cable guard 36 are configured to enable adjustment of the position of the cable guard 36 relative to the guard holder 34. As shown in FIGS. 3 and 5, this adjustment is along a lateral adjustment axis LA. To enable the adjustment, the guard holder 34 is configured to movably receive a portion of the cable guard 36 for adjustment of the position of the cable guard 36, and to be clampable to hold the cable guard 36 against movement once it is desirably located.

Figure 6:
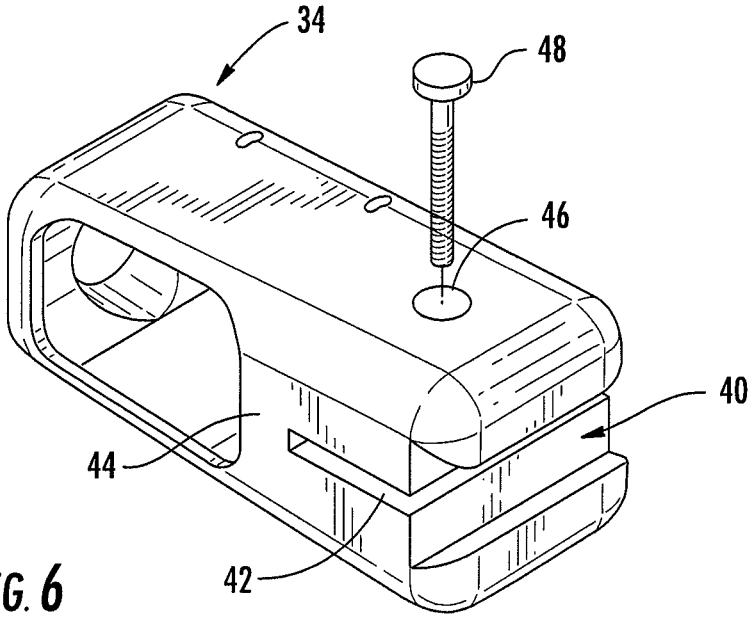
FIG. 6 is a detailed view of a holder component of the adjustable roller guard system of FIG. 1.

With reference to FIG. 6, the guard holder 34 includes a distal end configured to define an open ended clamping groove 40 and a bifurcating slit 42 that extends from the clamping groove 40 into a distal body 44 of the holder 34. The clamping groove 40 may preferably have a trapezoidal cross-sectional shape. The groove 40 is preferably open on each end, but may be open on just one end. The slit 42 enables adjustment of the width of the clamping groove 40.

The width of the clamping groove 40 may therefore be adjusted from a minimal width by fully compressing the slit 42 or to a maximum width by having no compression applied to the slit 42, in which case the clamping groove 40 may expand in width up to the flexibility or elasticity of the material used to provide the holder 34. As will be observed, when the guard holder 34 is installed on the rod 32 with the system 10 installed on the bow 12, the length axis of the clamping groove 40 corresponds to the lateral adjustment axis LA.

Compressive force may be applied to the slit 42, for example, by providing a bore 46 into the distal body 44 that extends substantially perpendicular to and spans the slit 42 and utilizing a fastener extended into the bore 46 to compress the slit 42. For example, a terminal end of the bore 46 may be threaded and threadably receive a fastener, such as a bolt 48, having a head that engages a portion of the distal body 44 opposite the terminal end 46 of the bore 46. Thus, tightening the bolt 48 will compress the slit 42.

Figure 7:
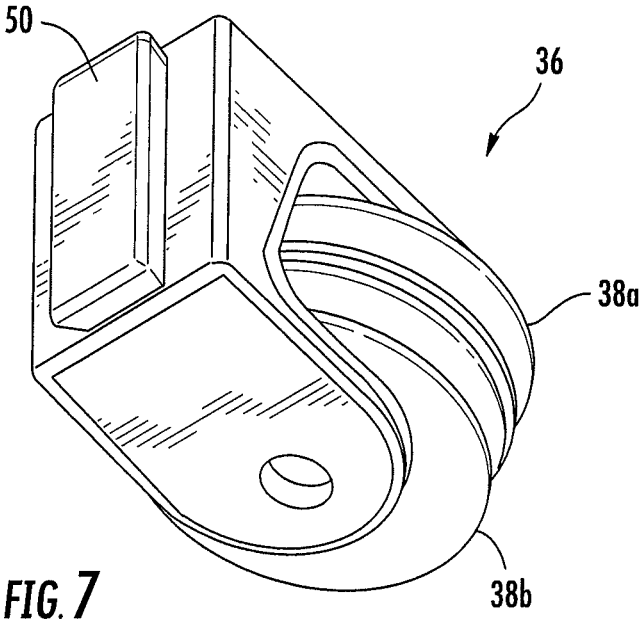
FIG. 7 is a detailed view of a guard component of the adjustable roller guard system of FIG. 1.

With reference to FIG. 7, the cable guard 36 includes a tongue 50 configured to be matingly and slidingly received by the clamping groove 40. As seen, the tongue 50 is of substantially the same cross-sectional shape as the groove 40 and may be slidingly inserted from one of the open ends of the groove 40.

As situated, the tongue 50 may move along the length of the groove 40, which enables the tongue to move along the lateral adjustment axis LA, thus enabling adjustment of the cable guard 36 along the lateral adjustment axis LA. The position of the tongue 50 within the groove 40 may be locked against movement by compressing the slit 42 such as described above to bear surfaces of the clamping groove 40 against surfaces of the tongue 50 to clamp the tongue 50 in a desired position.

Thus, in this manner, the lateral position of the cable guard 36 may be adjusted along the lateral axis LA to position and maintain the cable portions 26*a* and 28*a* of the bow 12 at the desired lateral spacing LS from the drawstring 28 and the fletching of the arrow. In the event the archer desires to change to an arrow having different fletching dimensions, the position of the cable guard 36 may be readily changed.

In alternate embodiments of the invention, the tongue may be located on the holder and the groove and slit located on the guard. Additionally, other mechanisms may be used which allow for lateral adjustment of a cable guard relative to the position of a holder.

The foregoing description of preferred embodiments for this disclosure has been presented for purposes of illustration and description. It is not intended to be exhaustive or to limit the disclosure to the precise form disclosed. Obvious modifications or variations are possible in light of the above teachings. The embodiments are chosen and described in an effort to provide the best illustrations of the principles of the disclosure and its practical application, and to thereby enable one of ordinary skill in the art to utilize the disclosure in various embodiments and with various modifications as are suited to the particular use contemplated. All such modifications and variations are within the scope of the disclosure as determined by the appended claims when interpreted in accordance with the breadth to which they are fairly, legally, and equitably entitled.

What is claimed is:

1. An adjustable cable guard system for an archery bow, comprising:

a guard holder and a cable guard held by the guard holder to engage a cable of the bow to maintain the cable a predetermined distance from a drawstring of the bow, the guard holder comprising a body having a clamping groove having a length axis and a bifurcating slit that extends from the clamping groove into the body of the holder, wherein the width of the clamping groove may be changed by application and removal of a compressive force to the slit, and the cable guard comprises a surface to bear against the cable of the bow and a tongue located to be matingly and slidingly received by the clamping groove, wherein the tongue may move along the length of the groove to enable adjustment of the position of the cable guard relative to the clamping groove to position the cable at a predetermined spacing from the drawstring of the bow, and wherein the position of the tongue within the clamping groove may be locked against movement by compressing the slit to bear surfaces of the clamping groove against surfaces of the tongue to clamp the tongue against movement and thereby maintain the cable at the predetermined spacing from the drawstring of the bow.

2. The cable guard system of claim 1, wherein the holder includes a bore extending into the body that extends substantially perpendicular to and spans the slit, and a fastener that is extended into the bore and rotated to compress the slit.

3. The cable guard system of claim 1, wherein the cable guard comprises a roller guard.

4. The cable guard system of claim 1, further comprising a rod located to extend outwardly from the archery bow, wherein the holder is positioned on a distal end of the rod.

5. The cable guard system of claim 1, wherein the predetermined spacing of the cable from the drawstring is selected so that the cable clears the Retching on an arrow being shot by the bow using the drawstring by a distance of from about 1/16 of an inch to about 5/16 of an inch.

6. An archery bow, comprising:

a riser, limbs extending from opposite ends of the riser, a wheel rotatably mounted on each of the limbs, a cable portion extending around each of the wheels, a drawstring connected to each of the wheels and offset from the cable portions, and a cable guard system for adjustably positioning the cable portions at a desired offset from the drawstring and maintaining the cable portions at the desired offset, the cable guard system comprising a rod extending outward from the riser generally toward the drawstring, a guard holder mounted to the rod, and a cable guard adjustably positionable on the guard holder to engage the cable portions, the guard holder comprising a body having a clamping groove having a length axis and a bifurcating slit that extends from the clamping groove into the body of the holder, wherein the width of the clamping groove may be changed by application and removal of a compressive force to the slit, and the cable guard comprises a surface to bear against the cable portions of the and a tongue located to be matingly and slidingly received by the clamping groove, wherein the tongue may move along the length of the groove to enable adjustment of the position of the cable guard relative to the clamping groove to position the cable portions, and wherein the position of the tongue within the clamping groove may be locked against movement by compressing the slit to bear surfaces of the clamping groove against surfaces of the tongue to clamp the tongue against movement and thereby maintain the positions of cable portions.

7. The bow of claim 6, wherein the holder includes a bore extending into the body that extends substantially perpendicular to and spans the slit, and a fastener that is extended into the bore and rotated to compress the slit.

8. The bow of claim 6, wherein the cable guard comprises a roller guard.

9. The bow of claim 6, wherein the clamping groove is open on both ends thereof.

* * * * *